US007183911B2

(12) United States Patent
Sanoner et al.

(10) Patent No.: US 7,183,911 B2
(45) Date of Patent: Feb. 27, 2007

(54) BABY MONITOR

(75) Inventors: Hughes Sanoner, New Territories (HK); Desmond Wai Nang Tse, New Territories (HK); Ronald Tak Yan Yim, New Territories (HK)

(73) Assignee: Solar Wide Industrial Ltd., New Territories (HK)

( * ) Notice: Subject to any disclaimer, the term of this patent is extended or adjusted under 35 U.S.C. 154(b) by 109 days.

(21) Appl. No.: 10/835,291

(22) Filed: Apr. 30, 2004

(65) Prior Publication Data

US 2004/0246136 A1 Dec. 9, 2004

Related U.S. Application Data

(60) Provisional application No. 60/466,775, filed on May 1, 2003.

(51) Int. Cl.
*G08B 1/08* (2006.01)

(52) U.S. Cl. ..... 340/539.15; 340/539.1; 340/573.1; 340/5.26; 455/67.13; 455/462

(58) Field of Classification Search ..... 340/539.15, 340/539.1, 539.11, 540, 573.1, 539.23
See application file for complete search history.

(56) References Cited

U.S. PATENT DOCUMENTS

| | | | | |
|---|---|---|---|---|
| 4,853,674 | A * | 8/1989 | Kiss | 340/407.1 |
| 5,223,815 | A * | 6/1993 | Rosenthal et al. | 340/539.21 |
| 5,786,767 | A * | 7/1998 | Severino | 340/628 |
| 6,043,747 | A * | 3/2000 | Altenhofen | 340/573.1 |
| 6,467,059 | B1 * | 10/2002 | Ohashi | 714/749 |
| 6,847,302 | B2 * | 1/2005 | Flanagan et al. | 340/666 |

* cited by examiner

*Primary Examiner*—Davetta W. Goins
(74) *Attorney, Agent, or Firm*—Leydig, Voit & Mayer, Ltd.

(57) ABSTRACT

A baby monitor has a nursery unit and parent unit. The nursery unit has a controller for generating a privacy code, a microphone for detecting baby sounds and a transmitter for transmitting a signal made up of the privacy code and the baby sounds. The parent unit has a receiver for receiving the signal, a controller for comparing the privacy code to a reference code, and an amplifier and speaker for outputting the baby sounds. The baby sounds are output by the parent unit if the privacy code matches the reference code. The nursery and parent units have a scrambler and descrambler respectively for scrambling the signal.

16 Claims, 5 Drawing Sheets

BABY MONITOR

RELATED APPLICATION

This application claims the benefit of provisional application No. 60/466,775, filed May 1, 2003.

BACKGROUND TO THE INVENTION

1. Field of the Invention

The invention relates to baby monitors.

2. Background Information

Baby monitors that allow remote monitoring of a baby are well-known. The device typically includes a nursery unit which is place in a room with a baby or infant who is either playing or sleeping, and a parent unit which is located in another part of the house or building where the parent or guardian is. The nursery unit detects sounds made by the baby and transmits these sounds to the parent unit where it is output via a speaker. The parent unit may also have one or more visual indicators.

Privacy can be a problem with known baby monitors. If two families living in neighbouring flats of the same apartment complex purchase baby monitors of same frequency channels transmitted signals may be received by the parent unit in the neighbouring apartment. A parent or guardian may hear their own baby as well as the neighbouring baby sounds.

Security can also be a problem with known baby monitors. The baby monitors transmit audio signals at frequencies that can be received by other baby monitors and by commonly available radio receivers. It is therefore relatively easy for others to 'eavesdrop' on audio signals transmitted by baby monitors. This could pose a security problem if sensitive or confidential information is discussed while a baby monitor is 'listening'.

SUMMARY OF THE INVENTION

It is an object of the present invention to provide a baby monitor which overcomes or ameliorates the above mentioned problems.

According to a first aspect of the invention there is provided a baby monitor including:

a nursery unit having a controller for generating a privacy code, a microphone for detecting baby sounds and a transmitter for transmitting a signal, the signal comprising the privacy code and the baby sounds, and a parent unit having a receiver for receiving the signal, a controller for comparing the privacy code to a reference code, and an amplifier and speaker for outputting the baby sounds, wherein the baby sounds are output only if the privacy code matches the reference code.

Preferably, the nursery unit further includes a scrambler for scrambling the signal, and the parent unit further includes a descrambler for unscrambling the signal.

Preferably, the nursery unit controller comprises a memory unit storing a code lookup table and a processor for accessing the code lookup table for generating the privacy code.

Preferably, the parent unit controller comprises a memory unit storing a code lookup table, the lookup table including the reference code, and a processor for accessing the code lookup table and comparing the privacy code to the reference code.

Preferably, the scrambler and descrambler include a modulator and filter.

Preferably, the modulator includes a switch operating at a fixed frequency and an operational amplifier in a difference amplifier configuration.

Preferably, the fixed frequency is given by $f(c)-f(u)=f(l)$, where $f(c)$ is the fixed frequency, $f(u)$ is a frequency spectrum upper limit and $f(l)$ is a frequency spectrum lower limit.

Preferably, the nursery unit further includes means for signalling the parent unit and causing the parent unit to output a sound from the speaker and/or providing a visual indication.

According to a second aspect of the invention there is provided a method of scrambling/descrambling an audio signal in a baby monitor, the audio signal comprising an alternating amplitude over a frequency spectrum having an upper limit and a lower limit, the method comprising transforming the audio signal so as to mirror the amplitude within the frequency spectrum.

Preferably, transforming the signal comprises:

generating a multiplier signal, multiplying the audio signal and multiplier signal to give a resultant signal, and filtering the resultant signal to remove frequencies above and below the upper and lower limits.

Preferably, the multiplier signal has a frequency given by $f(c)-f(u)=f(l)$, where $f(c)$ is the multiplier signal frequency, $f(u)$ is the frequency spectrum upper limit and $f(l)$ is the frequency spectrum lower limit.

Preferably, the frequency spectrum upper limit is 20000 Hz and the frequency spectrum lower limit is 15 Hz.

Preferably, multiplying the audio signal and multiplier signal includes modulating the audio signal and multiplier signal.

Further aspects of the invention will become apparent from the following description, which is given by way of example only.

BRIEF DESCRIPTION OF THE DRAWINGS

An embodiment of the invention will now be described by way of example only and with reference to the accompanying drawing, in which.

DESCRIPTION OF THE PREFERRED EMBODIMENT

Figure 1:
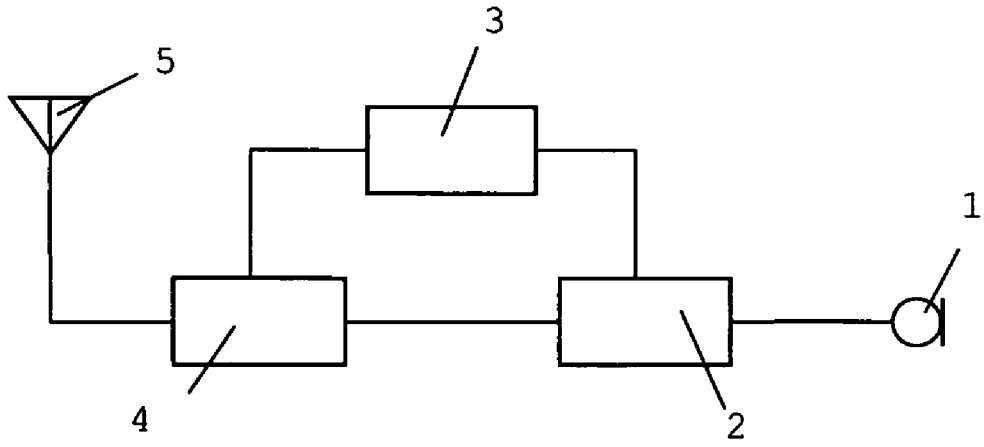
FIG. 1 is a schematic diagram of a first nursery unit for a baby monitor.
Figure 2:
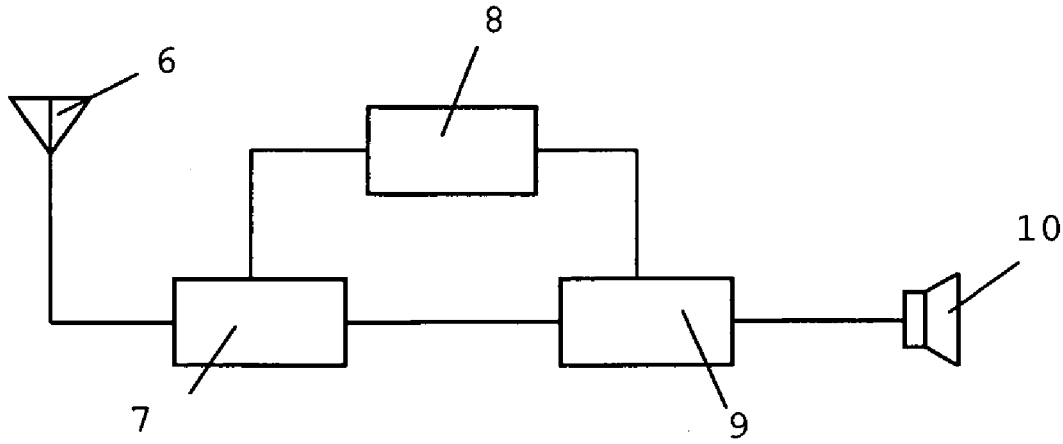
FIG. 2 is a schematic of a first parent unit for a baby monitor according to the invention.

Referring to FIGS. 1 and 2, a baby monitor includes a nursery unit and one of more parent units. A nursery unit for locating in a nursery with a baby to be monitored includes a microphone 1 for detecting sounds, a microphone amplifier 2, a controller 3, a transmitter 4 and an antenna 5. The microphone 1 detects sounds made by the baby. The sounds are amplified by the microphone amplifier 2 and transmitted by transmitter 4 and antenna 3.

The parent units include an antenna 6, a receiver 7, a controller 8, an amplifier 9 and a loudspeaker 10. The antenna 6 and receiver 7 receive the transmitted signal from the nursery unit. The received signal is amplified by the amplifier 9 for output over the loudspeaker 10. The nursery and parent units are controlled by controllers 3 and 8.

In one aspect of the invention the transmitted baby sounds are preceded by a privacy code. If the code is not recognised by the parent unit then the parent unit will not output the baby sounds over the speaker. In the preferred embodiment the code is transmitted as a digital signal followed by the analogue baby sound. To avoid the possibility that the privacy code used in one baby monitor coincides with the code used in another nearby baby monitor the privacy code is a randomly generated by the nursery unit controller 3 when it is turned on. Because a randomly generated code is used, the nursery unit and parent unit must undergo code registration before normal operation.

Figure 10:
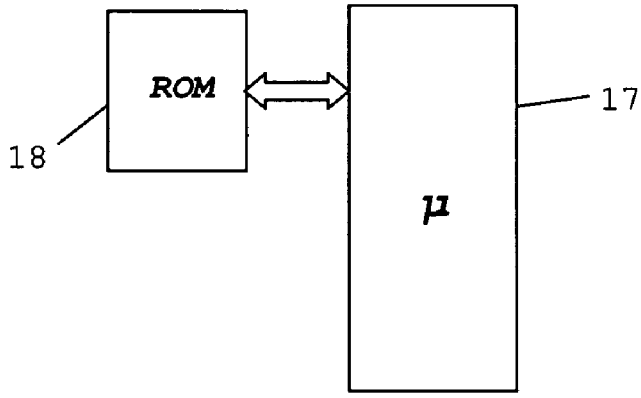
FIG. 10 is a schematic of a controller for the nursery and parent units.

Referring to FIG. 10, the controllers 3, 8 each comprise a microcontroller 17 and Read Only Memory (ROM) 18 for storing a pre-set code table. When the nursery unit is turned on its controller 3 generates a digital code randomly chosen from the code table. When the parent unit is turned on it communicates with the nursery unit to obtain the generated digital code and compares the code with its own pre-set code table for verification. If the digital code is verifiable as a valid code it is stored in microcontroller 17 memory as the reference identity for the nursery unit. After the parent unit has registered the valid code it generates a sound or uses a visual indicator light to indicate that code registration with the nursery unit was successful.

If the parent or guardian wishes to have more than one parent unit operating, for separate rooms, they turn on the second parent unit after receiving confirmation of successful code registration from the first parent unit. The second parent unit then undergoes the same code registration procedure of communicating with the nursery unit to obtain the digital code, verifying it, and storing in memory as the identity of the nursery unit. Additional parent units may be used and each is turned on, one-by-one, to undergo code registration before the next unit is turn on.

In order to insure that a parent unit undergoes code registration with the correct nursery unit, and not a nursery unit from a neighbouring apartment, the registration must be completed within a fixed time period, say 60 seconds, of the nursery unit being turned on. The nursery unit is turned on and randomly generates the digital code. For code registration to be successful the first parent unit must be turned on within 60 seconds of the nursery unit. If the nursery unit does not register a parent unit within 60 seconds of being turned on it will not allow registration of a parent unit. This prevents a person in the neighbouring flat turning on their parent unit at a later time and the parent unit undergoing code registration with the nursery unit from the neighbouring flat.

Once code registration is completed the nursery and parent units go into normal operation mode. The parent unit has its output speaker 10 muted. The nursery unit is monitoring the input from its microphone 1. If the sound level received by the microphone 1 is above a pre-determined threshold level the nursery unit will transmit the privacy code and then the detected sounds. The parent unit receives the transmitted code and sounds, and if the code matches the registered code the parent unit un-mutes its speaker 10 function and plays the baby sounds over the speaker 10. If the privacy code does not match the registered code then the parent unit remains muted.

In an alternative embodiment, the code is fixed, i.e. not randomly generated. The code is pre-set using hardwire jumpers connected to the controller 3 and to the controller 8. Corresponding nursery unit and parent unit are pre-set with the same code. Eight binary jumper inputs can provide a selection of 256 different codes, which means a 1-in-256 chance of coincidence of codes used by different baby monitor units. In yet a further embodiment the preset code is programmed into the ROMs 18 of the controller 3 and controller 8.

The nursery unit also has a parent-unit-finder function. Pressing a switch on the nursery unit will make the registered parent units provide audio and/or visual indication, which helps to locate them. The nursery unit transmits the privacy code followed by an activation code which is to enable the parent-unit-finder function. The preceding privacy code is to identify the parent units with codes matched, and any parent units unregistered or with codes mismatched would not produce any corresponding indication.

Figure 3:
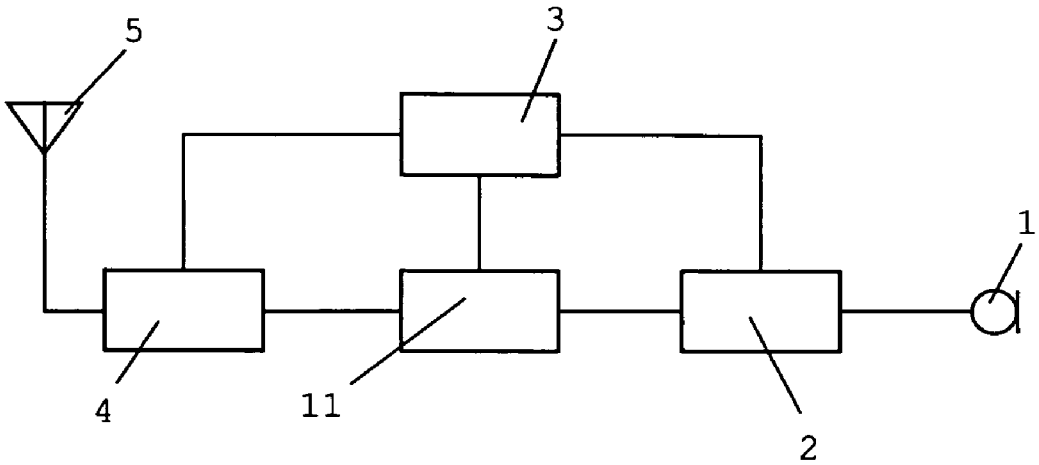
FIG. 3 is a schematic of a second nursery unit for a baby monitor.
Figure 4:
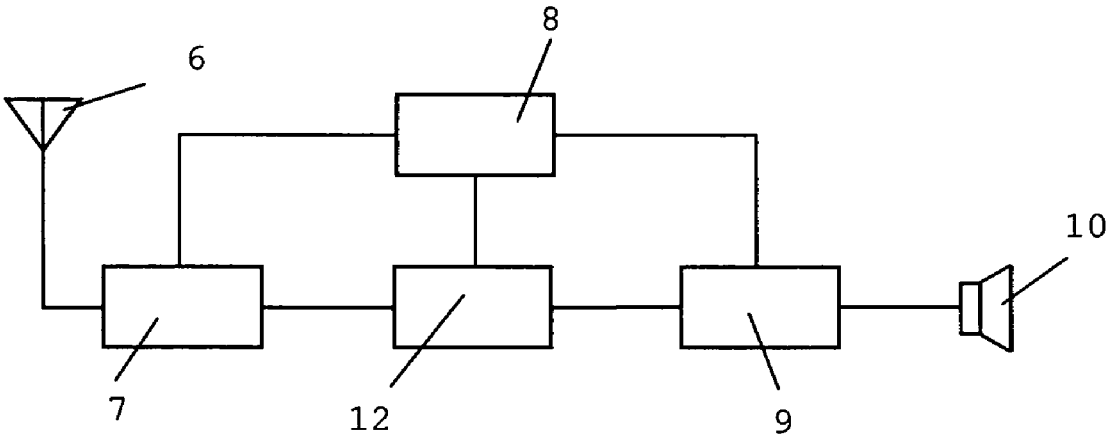
FIG. 4 is a schematic of a second parent unit for a baby monitor.

In one embodiment the baby monitor also includes security features. Referring to FIGS. 3 and 4, the nursery unit also includes a scrambler 11. The microphone 1 detects sounds made by the baby. The sounds are amplified by the microphone amplifier 2. The amplified sounds are scrambled by scrambler 11 and then transmitted by transmitter 4 and antenna 5. The parent unit includes a de-scrambler 27. The antenna 6 and receiver 7 receive the transmitted signal from the nursery unit. The received signal is de-scrambled by descrambler 12, amplified by amplifier 9 and output over loudspeaker 10.

The scrambler 11 and descrambler 12 may be a known scrambler IC. However, scrambler ICs are expensive.

A low cost scrambler is provided by transforming the audio signal amplitude to be mirror of itself within its frequency spectrum in order to make sounds incomprehensible. This is illustrated by the two graphs in the upper part of FIG. 5. The scrambled signal (right graph) lies within the same frequency spectrum as the original signal (left graph) and is a mirror image of the original signal in a graph of signal amplitude (level) versus frequency. To unscramble the signal the transformed signal is mirrored again in order to reveal the original signal and make the sounds comprehensible. Therefore, the scrambler is identical to the de-scrambler in terms of function and structure.

Figure 5:
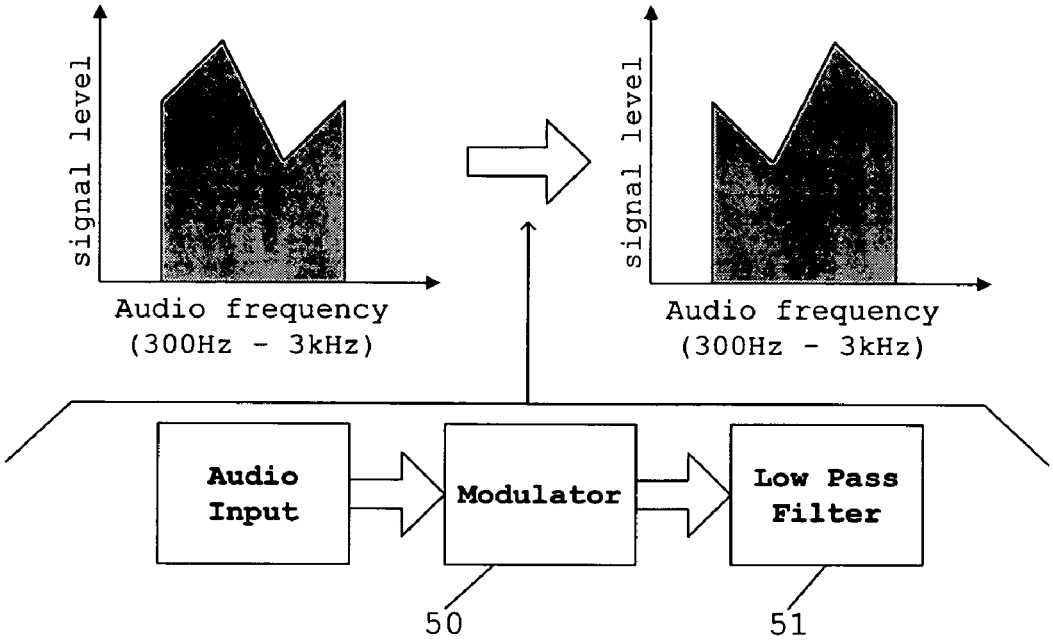
FIGS. 5 and 6 illustrate a system of scrambling an audio signal.
Figure 6:
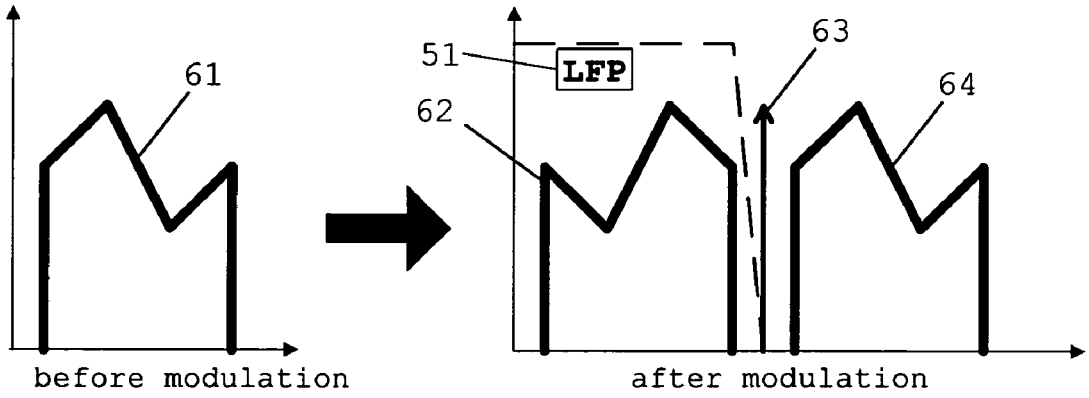

Referring to FIG. 5, mirroring of the audio signal amplitude within its frequency spectrum is achieved using a modulator 50 and a low pass filter 51. The modulator 50 acts as an analogue multiplier circuit. If two signals are multiplied the result is sum and difference signals. Referring to FIG. 6, if the sound signal 61 is multiplied by a carrier signal 63 the result is the carrier 63 and two sideband signals 62, 64. The low pass filter 51 is used to remove the carrier signal 63 and upper sideband 64 leaving the lower sideband 62 which is a mirror of original sound signal 61 within the frequency spectrum.

The frequency (fc) of the carrier signal 63 must be chosen so that the lower sideband 62 occupies the same frequency spectrum range as the original sound signal 61. The upper sideband 64 occupies the frequency range of fc+f(l) to fc+f(u) and the lower sideband 62 occupies the frequency range of fc−f(u) to fc−f(l): where f(l) and f(u) are the lower and upper limits of the sound signal 61 frequency spectrum respectively. In order to use the same modulator circuit to unscramble the sound signal by re-mirroring the frequency spectrum fc must be chosen such that fc−f(u)=f(l). For example, if the input signals spectrum is from 300 Hz to 3000 Hz then fc−3000=300 and so the carrier signal frequency fc=3300 Hz. The input signal frequency spectrum can include the range of frequencies that can be detected (heard) by the human ear. This is normally considered to be within the range of 15 Hz to 20000 Hz.

Figure 7:
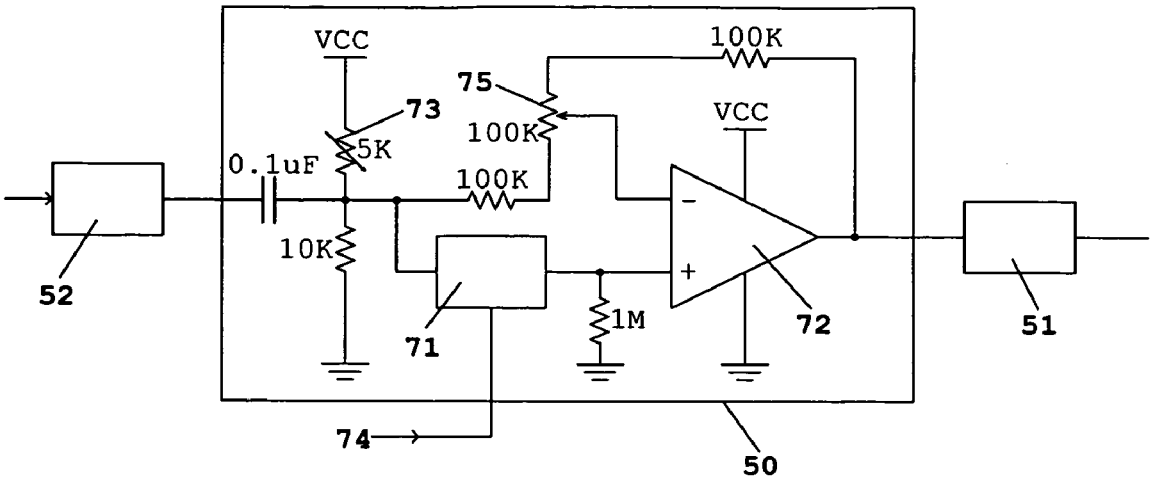
FIG. 7 illustrates a scrambler/descrambler.

FIG. 7 shows a circuit that can be used as both a scrambler 11 and de-scrambler 12. The circuit includes a modulator 50 having an analogue switch 71 connected to an operational amplifier 72. The analogue switch 71 can be any low cost commercially available analogue switch quad package. The modulator 50 requires only one of the four analogue switches. The remaining switches can be used in other areas such as signal flow control which helps to reduce the total cost of components. The operating frequency of the switch 71, which determines the carrier frequency, is determined by a frequency input 74.

A variable resistor 73 is provided at the input. The variable resistor 73 is tuned to minimise the content of the carrier signal 63 in the modulator output. If the carrier signal 63 content in the output is high a more expensive low pass filter 51 with deep roll off is required to remove the entire carrier signal 63. Because the variable resistor 73 can be tuned to minimise the carrier signal 63 content of the output the deep roll off low pass filter is not required, minimising cost.

The spectrum of the modulator input (sound signal 61) occupies exactly the same range of the frequency spectrum of the lower side band 62 of the modulator output. There would be a superposition or overlap problem if some of the frequency content of the sound signal 61 remained un-mirrored. In order to reduce this problem the feedback path of the amplifier 72 is provided with a variable resistor 75 which can be tuned to minimise any un-mirrored content in the modulator output.

A low pass filter 52 is provided before the modulator 50 to clean the audio signal 61 so that no higher frequencies/noises are present.

Figure 8:
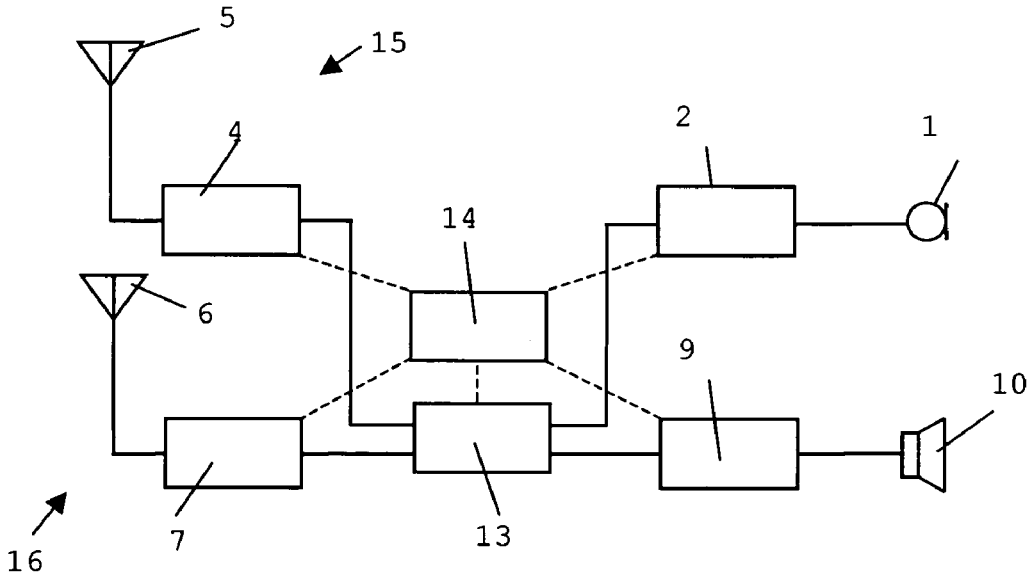
FIG. 8 is a schematic of a two-way half-duplex transceiver.

FIG. 8 shows two-way half-duplex transceiver that can be used for both a nursery unit and a parent unit. It comprises a transmitter portion 15 and receiver portion 16 and a single scrambler/de-scrambler circuit 13. A micro-controller 14 switches the circuit 13 between scrambler and de-scrambler modes for processing the sound signals.

The nursery unit, which is located in a nursery with a baby to be monitored, is always monitoring the baby sounds as in the case described previously. If the sound level received by the microphone 1 is above a pre-determined threshold level the nursery unit will transmit the privacy code and then the detected sounds. Whatever the sound level, the receiver portion 16 of the nursery unit is always active, detecting whether a parent unit is transmitting. When the sound level received by microphone 1 is higher than the threshold level, both the transmitter portion 15 and the receiver portion 16 of the nursery unit are working, one at each frequency channel.

The parent unit is usually in a "receive" mode, detecting whether the nursery unit is transmitting. The parent unit is provided with a transmit button (not shown) to switch it to "transmit" mode. In transmit mode the parent unit transmits sounds produced by the parent to the nursery unit.

The transmitted signal from the parent unit includes a privacy code and privacy code checking as described previously is performed both at nursery and parent units.

Because the transceiver unit of FIG. 8 has only one scrambler/de-scrambler circuit 13 it can only operate in either transmit mode or receive mode at one time. In normal operation mode, i.e. listening for baby sounds, the scrambler/de-scrambler circuit 13 of the nursery unit is set to scramble mode and the scrambler/de-scrambler circuit 13 of the parent unit is set to de-scramble mode. When the transmit button of the parent unit is pressed its controller 14 switches its scrambler/de-scrambler circuit 13 to scramble mode. A signal is transmitted to the nursery unit. When the nursery unit controller 14 detects that it has received a signal containing the privacy code it turns off the transmit function of the nursery unit and switches the nursery unit scrambler/de-scrambler circuit to de-scramble mode so that the received signal can be output on speaker 10. The nursery unit reverts to normal operation mode if a received signal containing the privacy code is absent for a pre-determined period of time, say 2 seconds.

Figure 9:
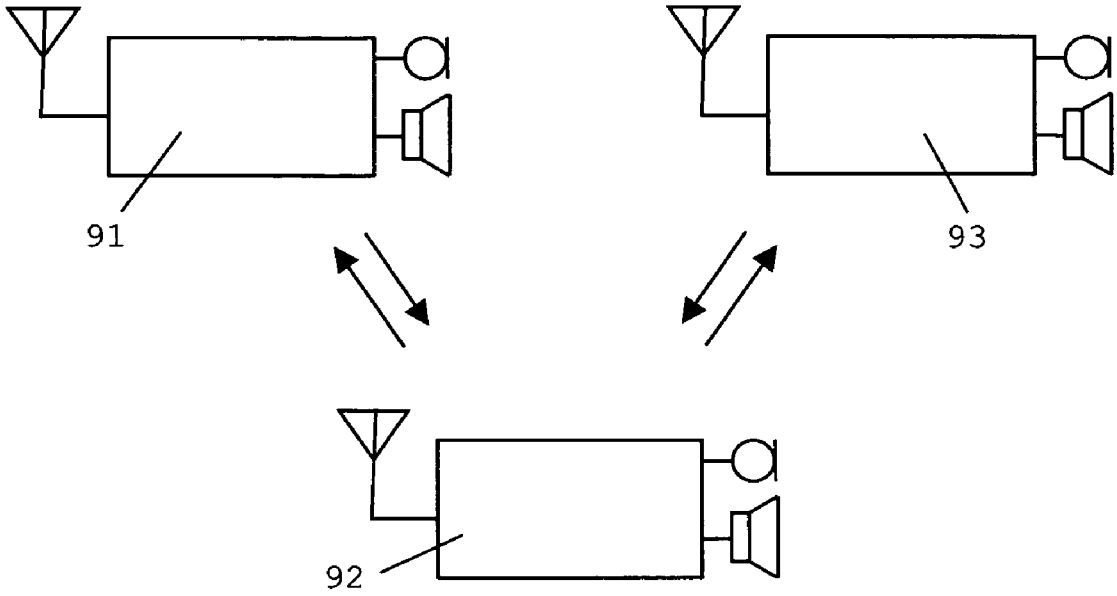
FIG. 9 illustrates a three-way walkie-talkie system.

Referring to FIG. 9, two parent units 91, 93 of the transceiver type shown in FIG. 8 are registered with a transceiver type nursery unit 92. If the units are using randomly generated privacy codes registration of two parent units proceeds as described previously. Alternatively, if fixed privacy codes are used then no registration is required. The three units can operate as a 3-way walkie-talkie system. The nursery unit 92 serves as the central unit for all communications between itself and either of the parent units 91, 93 or between the two parent units 91, 93. Parent-to-parent communication is performed via the nursery unit 92, and is an extra function over two-way communication system.

If a parent at parent unit 91 wishes to communicate with the nursery unit 92 a parent-to-baby button (not shown) is pressed on parent unit 91 to establish communication between parent unit 91 and nursery unit 92. When communication is established parent unit 91 will indicate that the nursery unit 92 is ready by an audio beep, visual indicator or similar.

Once communications have been established between a parent unit, in this case unit 91, and the nursery unit 92 a second parent unit, for example 93, will not be able to communicate with the nursery unit 92. If second parent unit 93 tries to establish communication with the nursery unit 92 then its signal will be rejected and a busy tone generated at second parent unit 93.

The nursery unit 92 may also act as a central link between parent units 91 and 93.

The privacy code checking described in nursery-to-parent simplex and two-way communication systems is also applied to the 3-way system. In addition, there is an identity code for each parent unit so that the nursery unit 92 can identify them accordingly, in order to establish communication from parent unit 91 to parent unit 93 or vice versa.

The identity code is an extra code following the privacy code. Alternatively, two different privacy codes are used for parent units 91 and 93 so the nursery unit identifies them by privacy code.

If a parent-to-parent button (not shown) is pressed on parent unit 91 then nursery unit 92 tells second parent unit 93 to enter receive mode only, by disabling its transmit mode. The speaker is muted on nursery unit 92 and communication signals are routed from parent unit 91 to second parent unit 93. Communication from parent unit 93 to parent unit 91 can be established in similar manner.

If both the parent-to-baby and parent-to-parent buttons are pressed on parent unit 91 then nursery unit 92 tells parent unit 93 to enter receive mode only, by disabling its transmit mode. The speaker is not muted on nursery unit 92, though communication signals are routed to parent unit 93. Both nursery unit and parent unit 93 can hear the sound signals from parent unit 91. Communication from parent unit 93 to nursery unit 92 and parent unit 91 can be established in similar manner.

Where in the foregoing description reference has been made to integers or elements have known equivalents then such are included as if individually set forth herein.

Embodiments of the invention having been described, however it is understood that variations, improvements or modifications can take place without departure from the spirit of the invention or scope of the appended claims.

What is claimed is:

1. A baby monitor including:

a nursery unit having a controller for generating a privacy code, a microphone for detecting baby sounds, a scrambler for scrambling a signal including the privacy code and the baby sounds, and a transmitter for transmitting the signal after scrambling; and a parent unit having a receiver for receiving the signal transmitted from the nursery unit, a descrambler for unscrambling the signal to produce the privacy code and the baby sounds, a controller for comparing the privacy code to a reference code, and an amplifier and speaker for outputting the baby sounds, wherein the controller supplies the baby sounds to the amplifier only if the privacy code matches the reference code.

2. The baby monitor of claim 1 wherein the controller of the nursery unit comprises a memory unit storing a code lookup table and a processor for accessing the code lookup table for generating the privacy code.

3. The baby monitor of claim 1 wherein the controller of the parent unit comprises a memory unit storing a code lookup table, the lookup table including the reference code, and a processor for accessing the code lookup table and comparing the privacy code to the reference code.

4. The baby monitor of claim 1 wherein the scrambler includes a modulator and filter.

5. The baby monitor of claim 4 wherein the modulator includes a switch operating at a fixed frequency and an operational amplifier in a difference amplifier configuration.

6. A baby monitor including:

a nursery unit having a controller for generating a privacy code, a microphone for detecting baby sounds, a scrambler for scrambling a signal including the privacy code and the baby sounds, and a transmitter for transmitting the signal; and a parent unit having a receiver for receiving the signal transmitted from the nursery unit, a descrambler for unscrambling the signal to produce the privacy code and the baby sounds, a controller for comparing the privacy code to a reference code, and an amplifier and speaker for outputting the baby sounds, wherein the controller supplies the baby sounds to the amplifier only if the privacy code matches the reference code, wherein the scrambler includes a modulator and a filter, the modulator includes a switch operating at a fixed frequency and an operational amplifier in a difference amplifier configuration, and the fixed frequency is given by $f(c)-f(u)=f(l)$, where $f(c)$ is the fixed frequency, $f(u)$ is a frequency spectrum upper limits and $f(l)$ is a frequency spectrum lower limit.

7. The baby monitor of claim 1 wherein the nursery unit further includes means for signalling the parent unit and causing the parent unit to output a sound from the speaker.

8. The baby monitor of claim 1 wherein the parent unit further includes a visual indicator, and the nursery unit further includes means for signalling the parent unit and causing the parent unit to activate the visual indicator.

9. A method of scrambling/descrambling an audio signal in a baby monitor, the audio signal comprising an alternating amplitude over a frequency spectrum having an upper limit and a lower limit, the method comprising transforming the audio signals to mirror the amplitude within the frequency spectrum by generating a multiplier signal, multiplying the audio signal and multiplier signal to produce a resultant signal, and filtering the resultant signal to remove frequencies above and below the upper and lower limits.

10. The method of claim 9 wherein the multiplier signal has a frequency given by $f(c)-f(u)=f(l)$, where $f(c)$ is the multiplier signal frequency, $f(u)$ is the frequency spectrum upper limit and $f(l)$ is the frequency spectrum lower limit.

11. The method of claim 9 wherein the frequency spectrum upper limit is 20000 Hz and the frequency spectrum lower limit is 15 Hz.

12. The method of claim 9 wherein multiplying the audio signal and multiplier signal includes modulating the audio signal and multiplier signal.

13. The baby monitor of claim 6 wherein the controller of the nursery unit comprises a memory unit storing a code lookup table and a processor for accessing the code lookup table for generating the privacy code.

14. The baby monitor of claim 6 wherein the controller of the parent unit comprises a memory unit storing a code lookup table, the lookup table including the reference code, and a processor for accessing the code lookup table and comparing the privacy code to the reference code.

15. The baby monitor of claim 6 wherein the nursery unit further includes means for signalling the parent unit and causing the parent unit to output a sound from the speaker.

16. The baby monitor of claim 6 wherein the parent unit further includes a visual indicator, and the nursery unit further includes means for signalling the parent unit and causing the parent unit to activate the visual indicator.

* * * * *